US005121857A

United States Patent [19]

Hutchinson

[11] Patent Number: 5,121,857

[45] Date of Patent: Jun. 16, 1992

[54] AGITATING AND DISPENSING ARRANGEMENT FOR BAG-IN-BOX CONTAINERS

[75] Inventor: David J. Hutchinson, Rugby, England

[73] Assignee: Corrugated Products Limited, Rugby, England

[21] Appl. No.: 378,590

[22] Filed: Jul. 11, 1989

[30] Foreign Application Priority Data

Jul. 16, 1988 [GB] United Kingdom ..... 8816999
Feb. 9, 1989 [GB] United Kingdom ..... 8902925

[51] Int. Cl.[5] ..... B65D 83/00

[52] U.S. Cl. ..... 222/318; 222/105; 366/136

[58] Field of Search ..... 222/318, 129.1, 129.2, 222/129.3, 129.4, 105, 400.7; 137/340; 366/136, 137; 239/127

[56] References Cited

U.S. PATENT DOCUMENTS

| | | | |
|---|---|---|---|
| 1,654,379 | 12/1927 | Matzka | 222/318 |
| 2,022,481 | 11/1935 | Schellenger | 137/563 |
| 2,169,514 | 9/1939 | Buzzard et al. | 239/127 |
| 2,757,800 | 8/1956 | Kucera | 239/127 |
| 3,149,555 | 9/1964 | Baum et al. | 222/318 |
| 3,185,348 | 5/1965 | Pollack et al. | 222/318 |
| 3,478,929 | 11/1969 | Cornelius | 222/318 |
| 3,920,163 | 11/1975 | Brown | 222/318 |
| 3,958,724 | 5/1976 | Ordway | 222/318 |
| 3,969,608 | 7/1976 | Day | 239/127 |
| 4,139,123 | 2/1979 | Castillo | 222/318 X |
| 4,394,966 | 7/1983 | Snyder et al. | 239/127 |
| 4,696,417 | 9/1987 | Ugolini | 222/318 |
| 4,699,298 | 10/1987 | Grant et al. | 222/400.7 |
| 4,706,847 | 11/1987 | Sankey et al. | 222/400.7 X |
| 4,742,939 | 5/1988 | Galockin | 222/318 X |
| 4,784,299 | 11/1988 | Stenger | 222/400.7 X |
| 4,856,683 | 8/1989 | Beaston | 222/318 |

FOREIGN PATENT DOCUMENTS

| | | | |
|---|---|---|---|
| 0152283 | 8/1985 | European Pat. Off. . | |
| 0001612 | 1/1977 | Japan | 239/127 |
| 8605767 | 10/1986 | World Int. Prop. O. . | |

*Primary Examiner*—Michael S. Huppert
*Assistant Examiner*—Anthoula Pomrening
*Attorney, Agent, or Firm*—W. Thad Adams, III

[57] ABSTRACT

An agitating apparatus, especially but not exclusively for dispensing fruit juices from a bag-in-box arrangement, includes a connector (18) adapted for fitment to the bag and having an inlet (20) and at least one outlet (22) each connected to a pump whereby on operation of the pump the bag's contents are agitated, the contents being dispensed by way of a dispenser (32) either interposed in a line between the pump and inlet (20) or connected to a second outlet (46) from the dispenser.

2 Claims, 4 Drawing Sheets

24
18
OUT
IN
22
20
34
36
32
12
10
14
16
20
IN
22
OUT
24
18
28
30
26

AGITATING AND DISPENSING ARRANGEMENT FOR BAG-IN-BOX CONTAINERS

The present invention concerns improvements in/or relating to agitating apparatus, especially but not exclusively agitating apparatus for use with beverages supplied in flexible plastics materials bags contained within cardboard containers. Such arrangements are often known as "bag-in-box oontainers".

Where the liquid to be dispensed from the bag has particles suspended therein, for example, a fruit drink, unless the liquid is constantly agitated or agitated before each serving the beverage delivered will not contain the desired amount of suspended particles.

It is the object of the present invention to obviate or mitigate this disadvantage.

According to the present invention there is provided an agitating apparatus comprising a connector adapted to be fitted to the dispensing spout of a bag-in-box container, a dispenser, a pump for conveying liquid from the connector, and fluid lines between the connector, pump and dispenser being arranged such that when no fluid is being dispensed from the dispenser there is a return flow of fluid back to the connector.

Preferably the dispenser is interposed in a line between the pump and the connector. Alternatively it can be connected to a separate line from the connector so that dispensing by gravity can be achieved.

Preferably the pump is a peristaltic pump. The dispenser arrangement may be a tap.

Preferably the connector includes inlet and outlet ports, the outlet port being connected by way of the pump to the dispenser and inlet port being connected also to the dispenser to return any liquid passing therethrough to the connector.

Alternatively the connector includes an inlet port and first and second outlet ports the first outlet port being connected by way of the pump to the inlet port so that liquid can be circulated by the pump, the second outlet port being connected to the dispenser.

The second outlet port may be formed on a first connector component which is connectable to a further connector component mounting the inlet and first outlet in a removable fluid tight manner.

Preferably the inlet port in use is located at a higher level than the outlet port.

An embodiment of the present invention will now be described by way of example only with reference to the accompanying drawings in which.

Figures 1, 2:
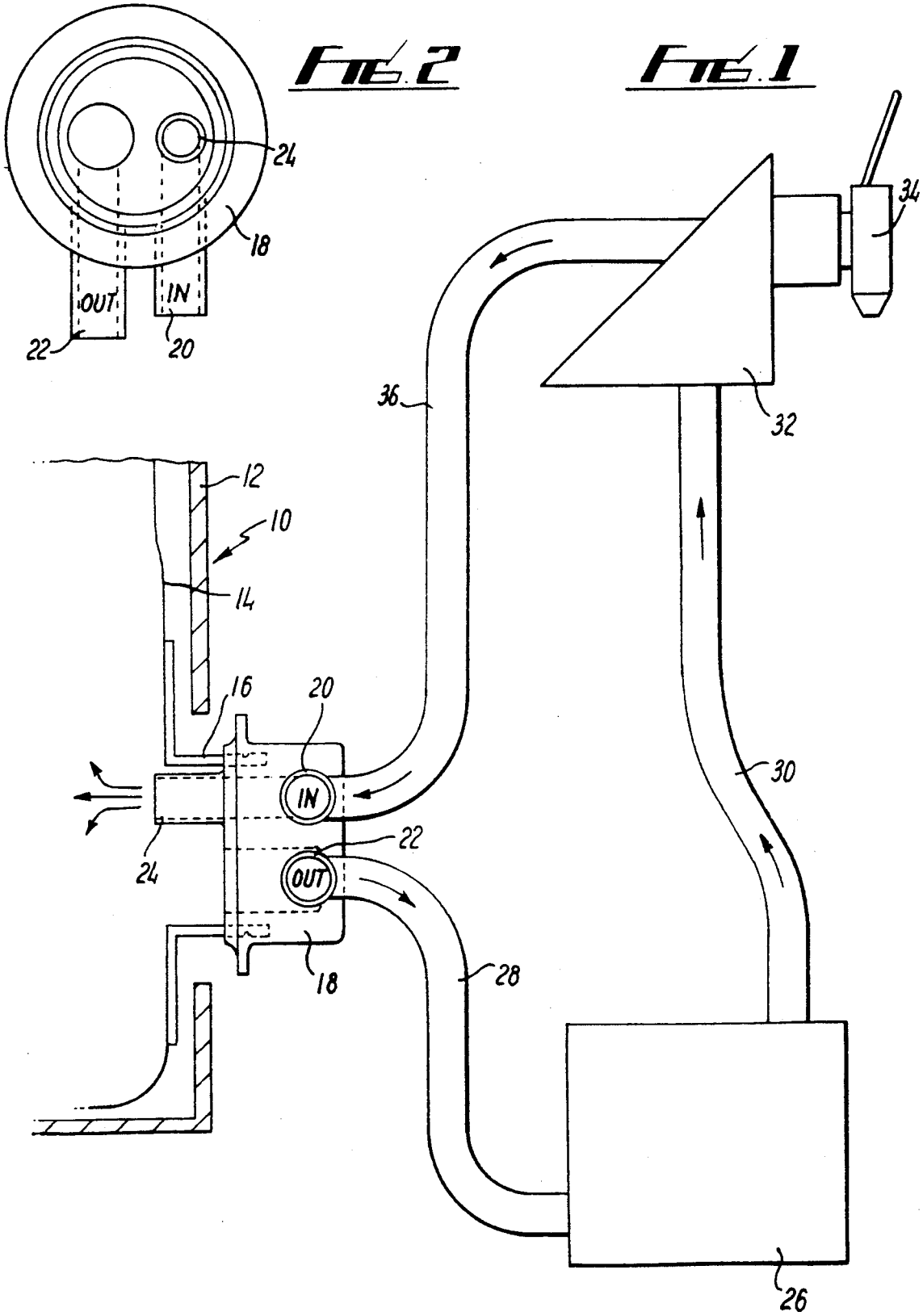
FIG. 1 shows diagrammatically an agitating and dispensing arrangement connected to a bag-in-box container.
FIG. 2 shows a rear elevation of a first form of connector.

FIG. 1 shows a bag-in-box container 10 comprising an outer corrugated paper box 12 enclosing a metalised plastics material flexible bag 14 which contains, in the present instance, a fruit drink having fruit particles suspended therein.

A dispensing spout 16 is permanently attached to the bag 14 and has a connector assembly 18 fitted thereto. The connector 18 has inlet port 20 and an outlet port 22, the inlet port connecting to a return nozzle 24 projecting into the bag 14. For transportation and storage the inlet and outlet ports have fluid-tight caps (not shown) fitted thereto.

The apparatus includes also a pump assembly 26 which, during use of the apparatus is constantly driven. In the present embodiment the pump is a peristaltic pump but any suitable pump could be employed. The pump is connected to the outlet 22 of the connector 18 by means of suitable flexible line 28 and further line 30 leads from the pump to a dispensing assembly 32 including a manually operated tap 34. The pump outlet line 30 has a branch in the dispenser 32 leading to the tap 34 and a further unobstructed branch leading to a return line 36 connected to the inlet port 20 of the connector 18.

In operation, when a bag-in-box containing fruit juice has been brought to a suitable location, its transportation and storage caps are removed from the spigots defining the inlet and outlet ports and the outlet and inlet lines 28, 36 are fitted over the spigots. The pump 26 is then started and is allowed to run even although no dispensing is taking place. The pump removes product from the bag and pumps it round the circuit including the connector and lines 28, 30, 36. This liquid circulation coupled with the projecting nozzle 24 results in an agitation of the product in the bag and the dispersion of any solid particles in the bag throughout the liquid.

When a dispensing operation is required the tap 34 is operated and liquid is dispensed in the normal manner. During this dispensing all of the liquid exiting from the pump 26 may be dispensed or only part of the liquid, the remainder, not dispensed, returning to the bag by way of line 36 as normal.

As the contents of the bag are exhausted the bag collapses without the ingress of any contaminating air.

It is readily apparent that the agitating and dispensing apparatus described above is far superior to existing apparatus where, for example, the product to be dispensed is emptied into a tank, which is open to atmosphere and agitated by a paddle mechanism rotating in the tank.

In a first modified arrangement dispensing by the effects of gravity is achieved. The connectors shown in FIGS. 3 to 6 are utilised in the modification where a further outlet port 46 is provided on the connector 18 and is connected to a dispensing tap 34 by a further line which is not illustrated.

Figure 3:
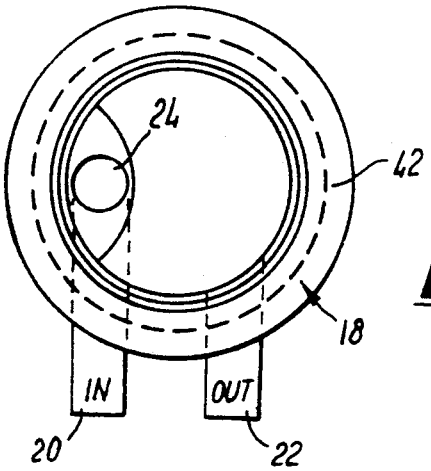
FIGS. 3 and 4 show respectively a rear elevation and end view of a first modified connector.
Figure 4:
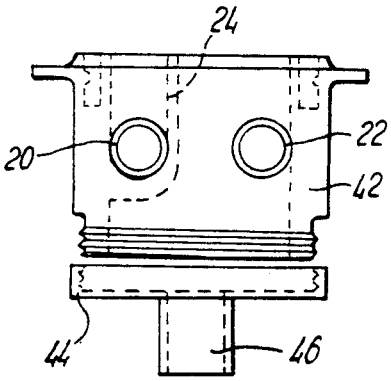

The connector of FIGS. 3 and 4 comprises two components a second hollow cylindrical body part 42 from which project the inlet 20 and a first outlet 22 and to which can be snap fitted a cap or first connection component 44 carrying a second outlet 46 from which the line to the dispenser 34 is connectable. In this embodiment the nozzle 24 from the inlet 20 is located above the entry to the first outlet 22.

In use the first outlet 22 is connected by a line to the pump 26 and the discharge from the pump is returned to the connector inlet port 20 by a line so that when agitation of the bag's contents is required the pump is operated. This agitation operation can be continuous or intermittent, as desired.

A length of line (not shown) is attached between the inlet 20 and first outlet 22 prior to filling the bag and during storage and transportation to eliminate contamination and ease use.

Figure 5:
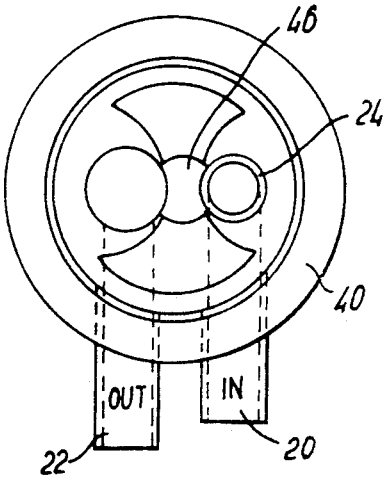
FIGS. 5 and 6 show respectively a rear elevation and end view of a second modified connector.
Figure 6:
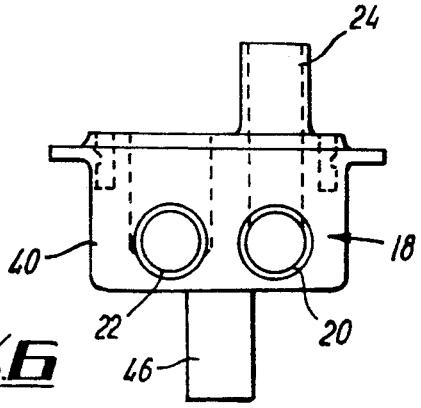
Figure 7:
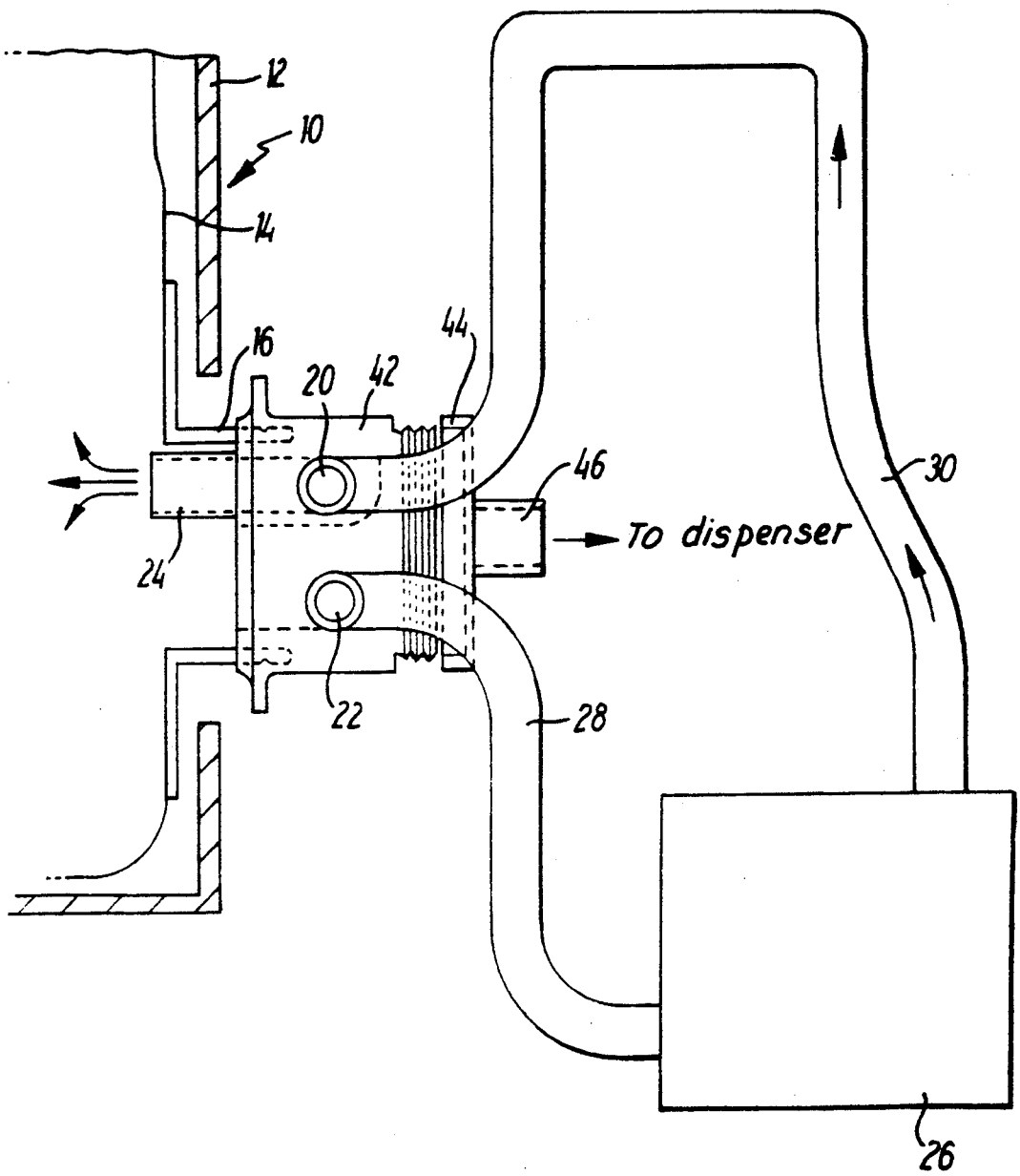
FIG. 7 shows an agitating and dispensing apparatus with the connector having a body part carrying the inlet port and first outlet port and the first connector component carrying a second outlet port.
Figure 8:
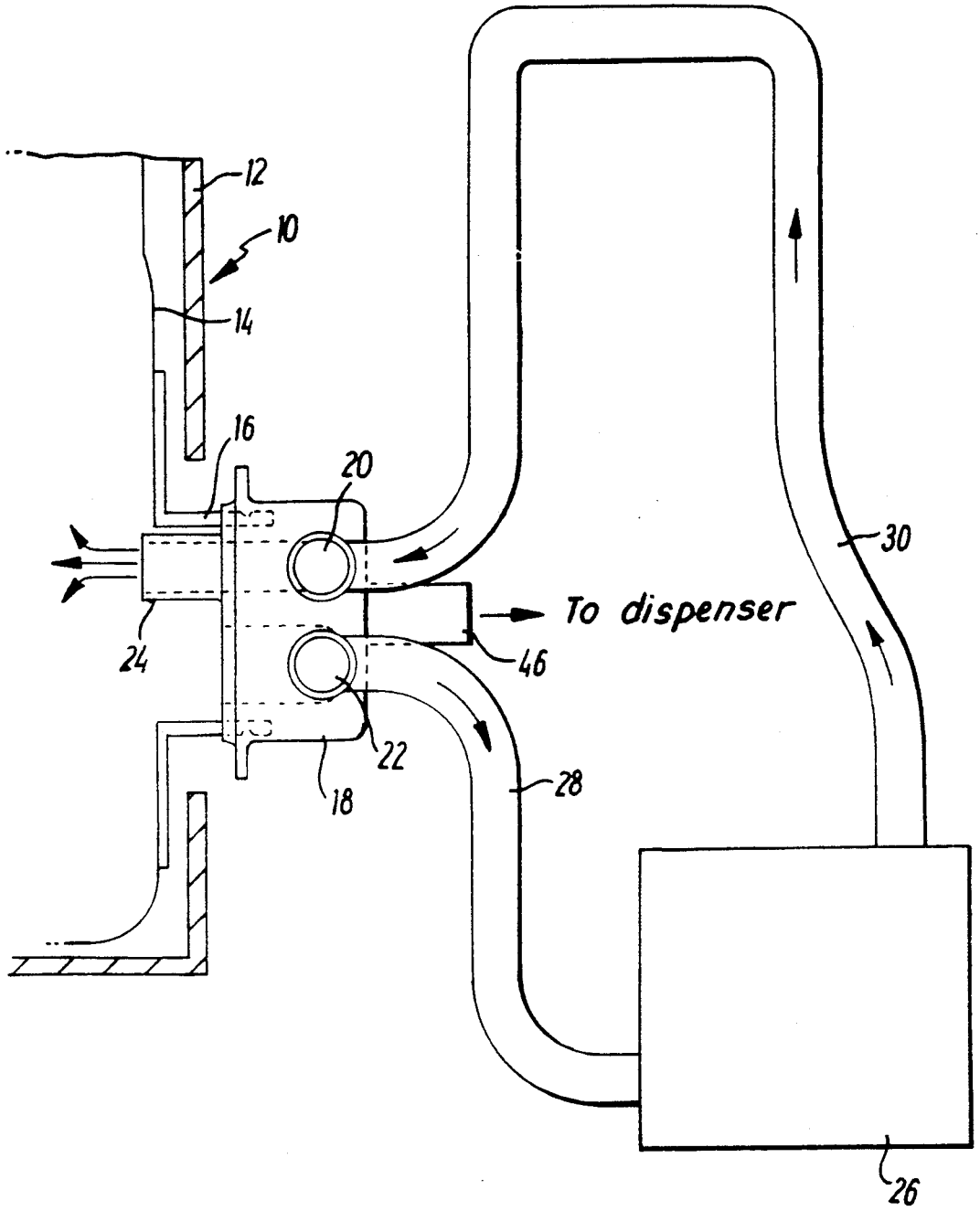
FIG. 8 shows an agitating and dispensing apparatus with the connector carrying the inlet port and the first and second outlet ports.

In the modification shown in FIGS. 5 and 6 a connector 18 is formed in one piece and carries an inlet 20 and first and second outlets 22 and 46. This modification functions in the same manner as that shown in FIGS. 3 and 4 and similar components have been given the same reference numbers.

Various modifications apart from those discussed above, can be incorporated into the apparatus without departing from the scope of the invention, for example, the connector means may be modified to suit any particular container and the container need not be a bag-in-box container. It has been found that pumps of a peristalic type are particularly advantageous for this operation as no contamination is involved and the lines can readily be changed for cleaning or replacement. Any form of dispensing arrangement may also be utilised. The transportation and storage caps described with reference to FIGS. 1 and 2 may be replaced by the short length of tube described with reference to FIGS. 3 to 6.

I claim:

1. Agitating and dispensing apparatus adapted for being fitted to the dispensing spout of a bag-in-box container for liquids, said apparatus comprising a connector having a body part and a first connector component, an inlet port and a first outlet port formed on said body part, and a second outlet port formed on said first connector component, said body part being connectable to said first connector component in a removable fluid tight manner, a first liquid line between said inlet and said first outlet ports, a pump interposed in said first liquid line for moving liquid from and back to the container to agitate the liquid in the container, a dispenser for dispensing liquid, a second liquid line between said second outlet port and said dispenser, said dispenser being located below said second outlet port so that liquid can be dispensed from the container by the action of gravity.

2. Apparatus according to claim 1, in which there is a return nozzle connected to the inlet port, the length of the return nozzle being such that when the apparatus is in use the return nozzle lies substantially within the confines of the dispensing spout of the bag-in-box container.

* * * * *